US007713148B2

(12) United States Patent
Sweeney

(10) Patent No.: US 7,713,148 B2
(45) Date of Patent: May 11, 2010

(54) TOPOGRAPHY LINKED GOLF AID

(75) Inventor: Mark Sweeney, Celebration, FL (US)

(73) Assignee: Sweeney Holdings LLC, Celebration, FL (US)

( * ) Notice: Subject to any disclaimer, the term of this patent is extended or adjusted under 35 U.S.C. 154(b) by 15 days.

(21) Appl. No.: 11/000,452

(22) Filed: Nov. 10, 2004

(65) Prior Publication Data

US 2005/0101415 A1 May 12, 2005

Related U.S. Application Data

(60) Provisional application No. 60/519,390, filed on Nov. 12, 2003, provisional application No. 60/569,106, filed on May 7, 2004, provisional application No. 60/584,048, filed on Jun. 30, 2004.

(51) Int. Cl.
*A63B 57/00* (2006.01)
*H04N 7/18* (2006.01)
*A63B 63/00* (2006.01)

(52) U.S. Cl. ..... 473/404; 348/157; 273/317

(58) Field of Classification Search ..... 463/2, 463/3, 5, 49, 52, 53; 473/283, 409, 404–407, 473/150; 273/317; 348/157
See application file for complete search history.

(56) References Cited

U.S. PATENT DOCUMENTS 4,910,667 A * 3/1990 Tanaka et al. ..... 711/168
4,910,677 A * 3/1990 Remedio et al. ..... 700/92
5,013,070 A 5/1991 Maude, Sr.
5,136,686 A * 8/1992 Koza ..... 706/13
5,146,557 A * 9/1992 Yamrom et al. ..... 715/723
5,403,001 A * 4/1995 Skorpinski ..... 473/409
5,792,015 A * 8/1998 Hoyt et al. ..... 473/404
5,797,809 A * 8/1998 Hyuga ..... 473/407
6,165,083 A * 12/2000 Stenger et al. ..... 473/404
6,296,579 B1 10/2001 Robinson
6,456,938 B1 * 9/2002 Barnard ..... 701/213
6,592,473 B2 7/2003 McDonald et al.
6,638,173 B2 * 10/2003 Robinson ..... 473/131
6,774,932 B1 * 8/2004 Ewing et al. ..... 348/157
6,890,273 B1 * 5/2005 Perez ..... 473/404

OTHER PUBLICATIONS

Lorensen et al. "Green Golf Visualization" IEEE 1991 pp. 116-123, 416.*
Penner, A.R. "The Physics of Putting" Canadian Journal of Physics, 2002, vol. 80.*
The Physics of Putting, A. R. Penner, Can. J. Phys. 80:1-14(2002).
Golf Green Visualization, William E. Lorensen and B. Yamrom, pp. 116-123, G. E. Company, Corporate Research and Development.

* cited by examiner

*Primary Examiner*—Peter DungBa Vo
*Assistant Examiner*—Omkar Deodhar
(74) *Attorney, Agent, or Firm*—Christine Q. McLeod; Beusse, Wolter, Sanks, Mora & Maire, P.A.

(57) ABSTRACT

A method, apparatus, and program for computing a path, starting velocity, aim angle, and aim points for directing a putted golf ball from a point on a golf course to another point and incorporating such data into easily read charts or electronic media is provided. The invention also provides a means of determining the initial launch conditions and actual path a putted golf ball traveled on given its starting and ending ball positions.

19 Claims, 11 Drawing Sheets

TOPOGRAPHY LINKED GOLF AID

CROSS-REFERENCE TO RELATED APPLICATIONS

This application claims the benefit of U.S. Provisional Application Nos. 60/519,390 filed Nov. 12, 2003; 60/569,106 filed May 7, 2004 and 60/584,048 filed Jun. 30, 2004, each of which is incorporated herein by reference.

TECHNICAL FIELD

The present invention relates to golf aids, and, in particular, to a method, apparatus, and program for computing a golf ball trajectory based on surveyed golf course topography to provide a golfer with aiming and stroke indicia for a ball position relative to a desired target.

BACKGROUND ART

Golfing aids, such as GPS systems, laser range finders, and yardage books have been used in the past to assist a golfer in determining range and course characteristics for improving play. More recently, putting aids have been proposed to assist golfers in determining the slope of a green to establish an appropriate aim point for putting. Other systems have been proposed, based on putting green topography, to predict desired trajectories for a golf ball to take to fall into a golf cup. A number of patents and published applications exist which relate to such golfing aids, including U.S. Pat./Pub Nos. 6,774,932; 6,296,579; 6,592,473; 6,165,083; 5,013,070; 5,146,557; and 5,403,001; all of which are incorporated herein by reference in their entirety to the extent they are not inconsistent with the explicit teachings of this specification.

While the above-mentioned systems may provide the golfer with some information that may be useful for golfing, these devices may require measurements of topography be made by a golfer during play. In addition, such devices may not work on multi-sloped or non-uniformly sloped putting greens. Furthermore, information obtained from topology measurements may not be readily reducible for indicating a putting aim point or more detailed stroke information. Accordingly, there is a need in the art for a method that provides more effective ways to utilize topology information to provide a golfer with highly detailed and useful surface, path, aiming, stroke, and alternate stroke information.

The present invention is designed to address these needs.

SUMMARY OF THE INVENTION

Broadly speaking, the invention provides a method, apparatus, and program for computing a path, starting velocity, aim angle, and aim points for directing a putted golf ball from a point on a golf course to another point (any arbitrary location, including but not limited to the hole) and incorporating such data into easily read charts or electronic media. The invention also provides a means of determining the initial launch conditions and actual path a putted golf ball traveled on given it's starting and ending ball positions.

The invention can be implemented in numerous ways, including as a system (including a computer processing system), a method (including a computerized method), an apparatus, a computer readable medium, a computer program product, or a data structure tangibly fixed in a computer readable memory. Several embodiments of the invention are discussed below.

As a method, an embodiment of the invention includes surveying the topography of a golf hole, converting surveyed topography data into a 3-dimensional surface model, computing a path trajectory, an aim angle, and an initial velocity for the desired putt, calculating, from the aim angle, an aim point distance to the right or left of a target that the golfer should aim towards, further calculating a break point of the putt trajectory, and displaying suggested aiming and stroke information. The method may further include incorporating a set of aim point distances into graphical charts or electronic media so that aim points and stroke data for possible combinations of target and ball positions may be displayed.

The method of the present invention may be implemented as a computer program product with a computer-readable medium having code thereon. The program product includes a program and a signal bearing media bearing the program. As a computer system, an embodiment of the invention includes code devices executed by a processor of a computer system for receiving topographic information, current ball position information, target information, such as the location of the cup or any arbitrary end point, and computing and displaying aim points, path, and stroke information. The code devices execute the methods of the invention. As an apparatus, the present invention may include at least one processor, a memory coupled to the processor, and a program residing in the memory which implements the methods of the present invention. As a computer readable medium containing program instructions for receiving topographic information, current ball position-information, target information, and computing and displaying aim points, path, and stroke information. The invention may also be implemented as computer executable software code transmitted as an information signal, the code performing the methods of the invention.

Specifically, an embodiment of the invention includes a method of providing putting information comprising: (1) receiving a start position of a golf ball relative to the putting green; (2) receiving a desired target location relative to the putting green; and (3) calculating a putting parameter for propelling the golf ball from the start position to the target location based on a trajectory corresponding to a desired capture velocity of the ball, wherein the trajectory has a start point substantially corresponding to the start position and an end point substantially corresponding to the target location. The putting parameter comprises an aim angle, an initial velocity, and an aim point distance (and direction) relative to the target location based on the aim angle. Indicia indicative of the putting parameters are displayed for the user. The indicia comprise an aim point icon and an initial velocity icon. The method further includes receiving the desired capture velocity of the ball, wherein capture velocity is the velocity at which the ball passes through the target location including, but not limited to, being captured in the hole. Other parameters may include a green speed parameter and grain.

In a further embodiment of the invention, the method includes receiving topography information corresponding to a putting green; and converting the topography information into a three dimensional surface model for determining a plurality of trajectories, each trajectory corresponding to a plurality of capture velocities of the ball. The trajectories are determined by computing gradients between adjacent points of the three dimensional surface model along each trajectory; and predicting a motion of a simulated golf ball moving between the points along the trajectory based on the respective gradients between the adjacent points; a coefficient of rolling friction of the ball, and an initial condition of the ball. In an embodiment, the initial condition comprises a directional velocity of the ball. Indicia indicative of a slope direction and slope magnitude of a portion of the putting green are displayed to the user or provided as part of a putting aid. The difficulty of an attempt to propel the golf ball from the position to the target location may also be provided.

In a further embodiment, the plurality of trajectories is determined for substantially every grid point on the green. These trajectories are stored for later reference. The putting parameter is calculated by selecting optimal values from the grid points on the green closest to the position of a golf ball. Optionally, the putting parameter is calculated by selecting and averaging optimal values from the grid points on the green closest to the position of a golf ball. The putting parameter may also be calculated by selecting optimal values from the grid points on the green closest to the position of a golf ball to use as a basis for calculating the putting parameter for the actual ball coordinate.

The method of the invention further includes calculating an aim point distance relative to the initial break coordinates for the target location based on the aim angle. Moreover, the invention includes outputting audio indicia indicative of the putting parameters.

A contour chart may also be used. Specifically, indicia indicative of the putting parameters are displayed with the use of a contour chart. The contour chart utilizes different colors (or other variable indicia) to represent the putting parameters.

The position of a golf ball relative to the putting green may be received by one or more of global positioning (GPS) data, radio frequency data, optical data, or laser data. The position data may also be input by a user.

In an embodiment, the invention includes overlaying on an image stream transmission a visual path trajectory based on calculated putting parameters. Additionally, an image stream transmission may overlay a visual path trajectory representative of an actual path calculated from a known start point substantially corresponding to the position and a known end point substantially corresponding to the target location.

The invention also provides for simulation. Specifically, a putt may be simulated based on a simulated position of a golf ball.

Calculating the putting information includes determining for a plurality of location coordinates on a putting green optimal trajectories corresponding to a desired capture velocity for a golf ball to move from said location coordinate to an end point; and calculating putting parameters to propel a golf ball along a path substantially following the optimal trajectory.

As a computer-implemented simulation program, the invention provides for simulating green break characteristics for a green utilizing software code for receiving a simulated position of a golf ball relative to the putting green; and for calculating a putting parameter for propelling the golf ball from the simulated position to a target location based on a trajectory corresponding to a desired capture velocity of the ball, wherein the trajectory has a start point substantially corresponding to the position and an end point substantially corresponding to the target location.

In another embodiment, the invention includes a computing device (such as a hand held device, palm device, or the like) for providing putting information, comprising: input mechanism for receiving a position of a golf ball relative to the putting green and receiving a desired target location relative to the putting green; and a processor for calculating a putting parameter for propelling the golf ball from the position to the target location based on a trajectory corresponding to a desired capture velocity of the ball, wherein the trajectory has a start point substantially corresponding to the position and an end point substantially corresponding to the target location; and an output device such as a display for displaying the putting parameter or audio device for providing the putting parameter. The computing device may also include or have access to storage media for storing a plurality of predetermined trajectories, each trajectory corresponding to a desired capture velocity of the ball.

As computer readable media containing program instructions for providing putting information, the invention includes computer program code for receiving a position of a golf ball relative to the putting green; receiving a desired target location relative to the putting green; and calculating a putting parameter for propelling the golf ball from the position to the target location based on a trajectory corresponding to a desired capture velocity of the ball, wherein the trajectory has a start point substantially corresponding to the position and an end point substantially corresponding to the target location.

A chart for assisting a golfer in determining putting parameters for a green is also provided as part of the invention. The chart includes a contour chart representing the topography of the green; and a plurality of visual indicators on the contour chart representing putting parameters for propelling the golf ball from a plurality of start positions to a target location based on previously determined optimal trajectories for each of the start positions to the target location, each optimal trajectory corresponding to a desired capture velocity of the ball. The putting parameters include, for example, aim distances. The contour chart and visual indicators may be displayed on electronic media or on print media.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Figure 1:
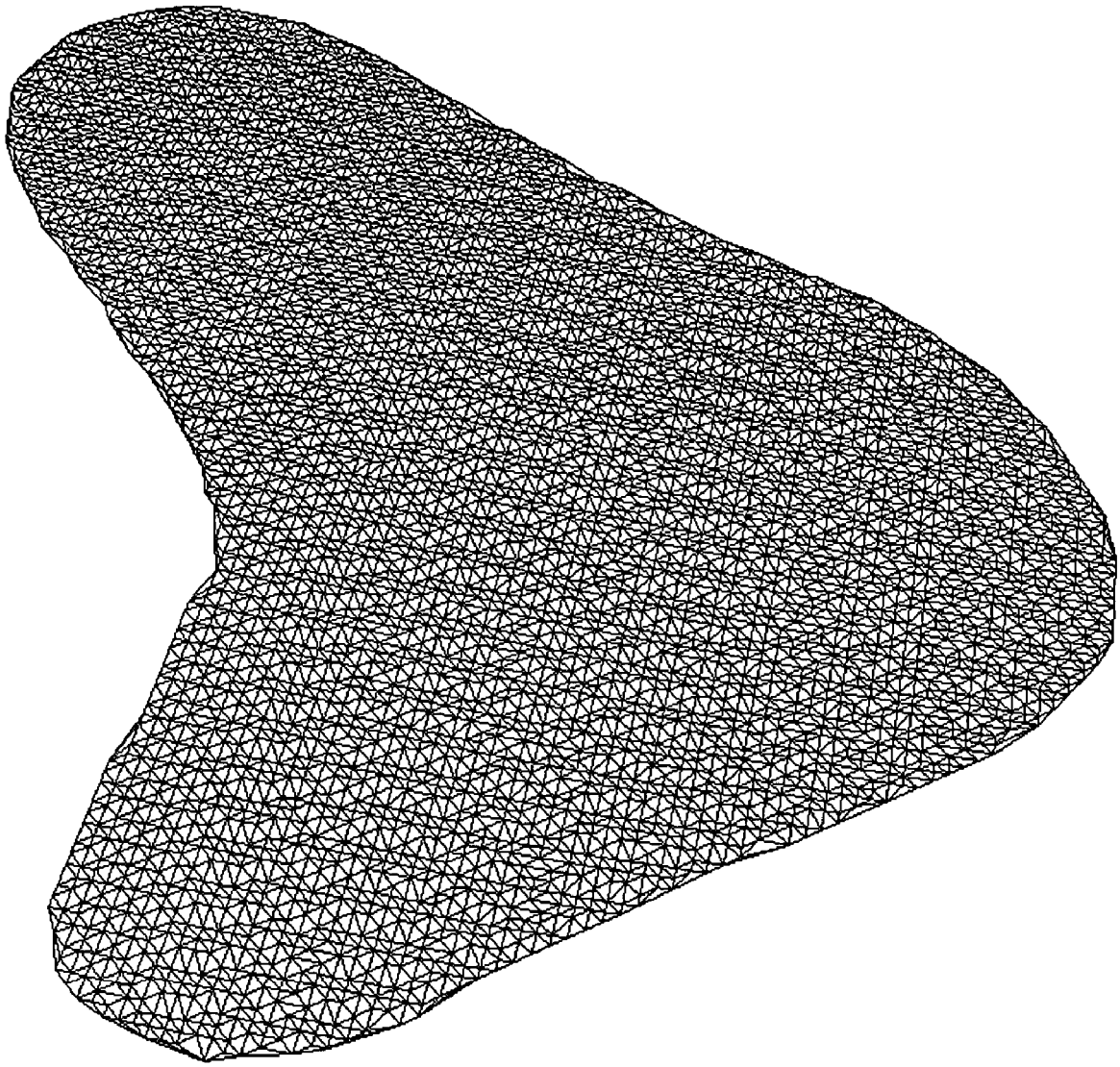
FIG. 1 is a wire-frame graphic of a smoothed putting surface used to simulate a trajectory of the putt.

While the present invention will be described with reference to the details of the embodiments of the invention shown in the drawings, these details are not intended to limit the scope of the invention.

DETAILED DESCRIPTION

Referring now to the drawings, embodiments of the present invention will be described. Generally speaking, the invention includes a method for computing path and stroke data for a successful golf shot from any point on a golf green (herein referred to as the starting point) to another point on the golf green (herein referred to as the target location which is any location including, but not limited to, the hole) based on topographic information, and incorporating such stroke data and surface information into easily read charts or electronic media.

Specifically, the invention provides methods and code devices for surveying the topography of a golf hole, converting surveyed topography data into a 3-dimensional smoothed surface model, computing the path, aim angle, and initial velocity for a desired shot taking into consideration the topography, starting point, target location, and capture velocity (the velocity at which the ball passes through the target point, including but not limited to, the velocity at which the ball is captured in the hole), determining, from the aim angle, an aim point distance to the right or left of a target that the golfer must aim towards, and displaying suggested path, aiming, and stroke information. The method may further include incorporating a set of surface characteristics, aim points, and path data into graphical charts or electronic media so that aim points and paths for any possible combination of target and ball position may be displayed or used as inputs to a putting device or aid. The method may also be used to create highly detailed surface maps of the golf green using directional arrows and color-coded elevation scales which may assist the golfer in understanding golf green surface topography.

Initially, topographic information is collected for a desired golf course, such as the putting green of each hole on the course. For example, a topography data collection process may be implemented by surveying a green with accurate measurement tools in order to obtain elevation data at various points within the green perimeter. A light detection and ranging device (LIDAR) is a known measurement tool capable of taking elevation points in small intervals. The survey readings of the perimeter and elevation are then converted into a digital terrain model (DTM) data file which can be read by commercially available geographic information system (GIS) software, as would be understood by a skilled artisan. The GIS software then uses the DTM file to generate a smoothed continuous representative green surface, such as shown in FIG. 1, using a number of different methods such as Kriging [7] and Triangulation[8]. One such method is described by Lorensen and Yamrom[1][2]. From the smoothed surface model a representative (x,y,z) elevation file with points of equal density is extracted and used as an input for the computer simulation which determines putt trajectories.

Golf Ball Trajectories

The first step in calculating ball trajectories is determining the gradient of the green at selected intervals. The slope of the green is determined by calculating from the elevation file the gradient components at each grid point with the following equations:

$$dz/dx(x,y)=(z(x+1,y)-z(x-1,y))/2dx \quad (1a)$$

$$dz/dy(x,y)=(z(x,y+1)-z(x,y-1))/2dy \quad (1b)$$

where dx and dy are the spacing of the grid points along the x and the y-axis respectively. To determine the gradient at intermediate points we interpolate using the four surrounding grid points. Given the gradient components, the slope along the x axis ($\theta$) and y axis ($\phi$) at any point is then given by:

$$\theta=\arctan(dz/dx) \quad (2a)$$

$$\phi=\arctan(dz/dy). \quad (2b)$$

Once the gradient components of the surface has been generated, a computer program may simulate the rolling of a golf ball on that surface using known equations of motion, thus allowing a variety of putt paths to be predicted. A golf ball putted on a green will be in a combined state of sliding and rolling during the first 10% to 20% of its path[6], but the trajectory will primarily be governed by the rolling motion.

Given this constraint of rolling the acceleration of the golf ball can be determined by knowledge of the forces being exerted on it by the turf and gravity. The force being exerted by the turf is normally treated as having components both perpendicular and parallel to its surface acting at a specific contact point on the ball. The perpendicular component is referred to as the normal force while the component parallel to the turf is referred to as the frictional force. The exact position of the contact point is determined by the amount of deformation that the turf undergoes as the golf ball rolls over it.

In analyzing the frictional force acting on a rolling ball it is usual to define a coefficient of rolling friction, $\rho$, which is equal to b/R where b is the position of the contact point and R is the radius of the golf ball. The acceleration of a golf ball rolling on a horizontal surface is given by:

$$a=-\rho g/(1+I/mR^2), \quad (3)$$

where g is the acceleration due to gravity (32.2 ft/s$^2$), m is the mass of the golf ball, and I is the moment of inertia of the golf ball about its center. Approximating the golf ball as a solid sphere results in $I=\frac{2}{5}mR^2$ and its acceleration is, therefore, given by:

$$a=-\tfrac{5}{7}\rho g \quad (4)$$

The deformation of the turf and the resulting coefficient of rolling friction, $\rho$, increase with the softness of the turf and the speed of the rolling golf ball. Research by A. R. Penner shows that $\rho$ can be determined by the following expression:

$$\rho=(0.7028/s)(1+0.0065v^2) \quad (5)$$

where s is the stimpmeter reading of the green and v is the speed of the golf ball. The frictional force can also be adjusted for the effect of grain with the formula:

$$\rho'=\rho^*(\delta^*\cos(\gamma-\beta));$$

Where $\delta$ is the magnitude of grain effect on the ball, $\gamma$ is the grain direction in degrees, and $\beta$ is the direction the ball is moving.

For a golf ball rolling on a sloped green, in addition to the frictional force, the ball will also experience a component of the gravitational force acting along its direction of motion. The acceleration of a golf ball on a green sloped along both the x-axis ($\theta$) and the y-axis ($\psi$) is given by:

$$a_x=-\tfrac{5}{7}\rho g\cos\theta\cos\psi\sin\beta-\tfrac{5}{7}g\sin\theta \quad (6a)$$

$$a_y=-\tfrac{5}{7}\rho g\cos\theta\cos\psi\cos\beta-\tfrac{5}{7}g\cos\theta\sin\psi \quad (6b)$$

where $\beta$ is the direction that the ball is moving with respect to the y-axis.

The path of the golf ball is determined by initial conditions, including launch direction and velocity, along with the equations of acceleration (2a) and (2b). The equations are run iteratively on a very small fixed time interval until the ball reaches its desired ending velocity, and determine the ball's position on the x-axis (x) and y-axis (y). The equations used are:

$$v_x(t+\Delta t)=v_x(t)+a_x\,\Delta t \tag{7a}$$

$$v_y(t+\Delta t)=v_y(t)+a_y\,\Delta t \tag{7b}$$

$$x(t+\Delta t)=x(t)+\tfrac{1}{2}(v_x(t+\Delta t)+v_x(t))\,\Delta t \tag{8a}$$

$$y(t+\Delta t)=y(t)+\tfrac{1}{2}(v_y(t+\Delta t)+v_y(t))\,\Delta t \tag{8b}$$

Solving for Paths

The process of calculating a successful putt trajectory given known values for green speed, capture speed, or starting and ending ball positions can be determined by using a number of non-linear solving techniques. R. Vanderbei[3] describes two such methods using commercially available software, provided that the initial velocity value must be close to optimal or the solvers can fail. A more reliable optimizer for use when the optimal value range is not known are genetic algorithm-based optimizers which can find optimal solutions to problems which are unsolvable for standard linear and non-linear solvers. Genetic algorithms are search algorithms which use principals of natural selection including crossover and mutation in order to find a best-fit solution where purely iterative searches are infeasible. Using these algorithms it is possible to solve for many different solutions to a putt depending on golfer preferences or desired ending ball position. There are many different starting ball conditions which will result in a successful putt because there is a range of ball speeds which can result in the capture of the ball by the hole. For a putt path that is desired to successfully fall in the hole, the capture of the ball by the hole must be such that the velocity of the ball when reaching the hole must be less than 1.56 to 1.63 m/s[3] for downhill and uphill putts, respectively. However, for every different velocity at which the ball arrives at the hole, different combinations of path and launch conditions are required.

Figure 2:
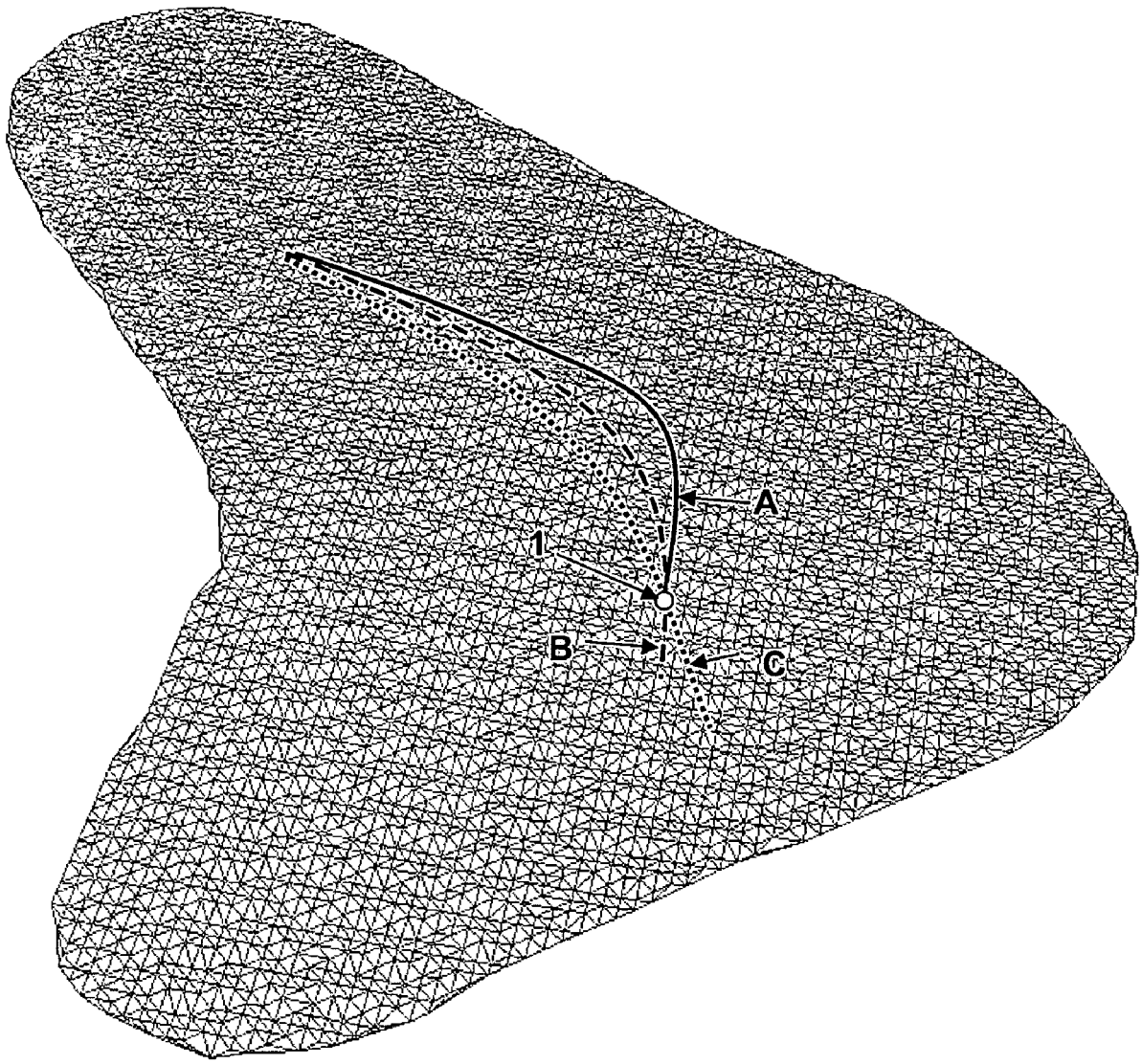
FIG. 2 depicts different possible trajectories of a putt passing through a given point with different capture velocities.

For example, FIG. 2 shows the different possible trajectories of a putt given different putting styles or velocities (capture velocities) at which the ball reaches and/or passes through the target location, i.e., the hole 1. The three lines A, B, C show putts with velocities that 1.) stop at the hole 1—Line A, 2.) stop 6 inches past the hole 1—Line B, and 3.) stop 18 inches past the hole 1—Line C. Depending on a putting preference of a golfer, a successful putt could follow any of these three trajectories, so it is necessary to be able to compute any or all of them so the individual golfer can choose a trajectory and launch conditions which match his putting preference.

The next step in the process is to loop through every grid point on the green and compute then store successful putt data for later reference. This is done so that when solving for a trajectory for a particular ball position, you already know close to optimal launch conditions and can very quickly calculate optimal launch values. For example, an actual putt which begins at (x,y) coordinate (15.67, 45.40) is much faster to optimize since we already have a database containing optimal values for points (15,45), (16,45), (15, 46), and (16,46). We simply choose the optimal values from the grid points closest to the actual ball coordinate, or average the optimal values from surrounding points, and use those values as beginning values to solve for the actual (15.67,45.50) ball coordinate. Beginning the genetic search with an initial data population which is close to optimal results in a very fast search for optimal conditions.

Figure 3:
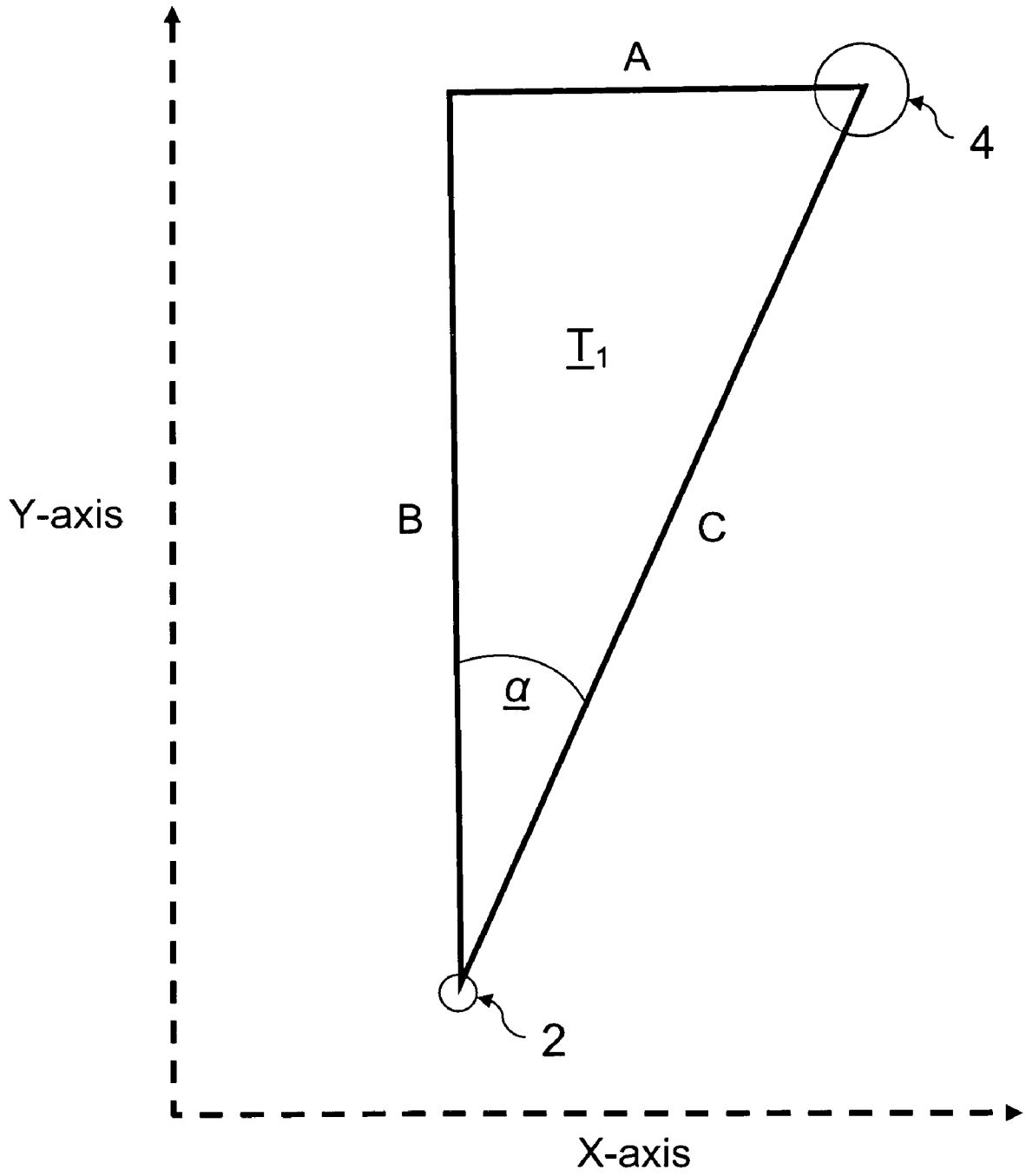
FIG. 3 shows a diagram for computing a distance C from a ball to a hole.
Figure 4:
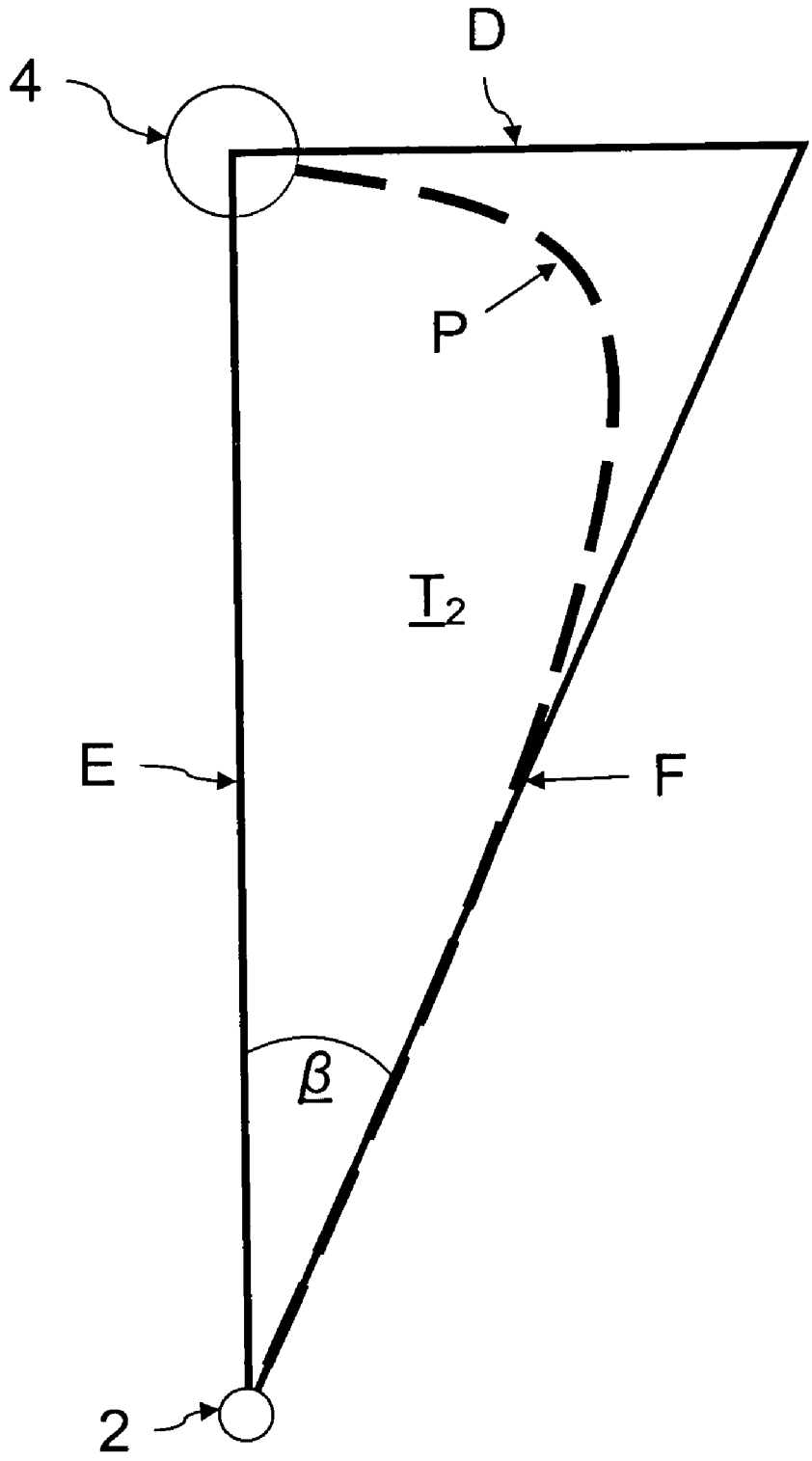
FIG. 4 is a diagram depicting a golf ball, a hole on a green, and a path of a putt.

Once required trajectories and optimal launch values have been pre-computed, that data can be used in graphical displays to aid in putting and in determining breaks in greens. For example, pre-computed trajectories can be stored in a memory of a hand held computer. The hand held computer may be programmed to accept a topography position, such as on a location on a desired putting green, and accept a ball position input by the user. Based on the input ball position, the computer finds the appropriate trajectory pre-computed in memory and indicates appropriate aiming and stroke information, based on the corresponding trajectory, to the user. In addition to being able to display the path of the putt and the initial launch angle and velocity, the present invention pre-computes the aim distance perpendicular to the right or left of the hole (which is how many golfers aim their putts) for any or all points on the green for a given hole position and green speed. FIGS. 3 and 4 show how this distance is computed. FIG. 3 shows how to compute the distance C from the ball 2 to hole 4. Length A is the distance between the ball 2 and the hole 4 on the x-axis of the green surface, and length B is the distance between the ball 2 and the hole 4 on the y-axis of the green surface. FIG. 4 is a drawing depicting a golf ball 2, a hole 4 on the green, and the path, P, of a successful putt. The length of side D of the right triangle $T_2$ is determined by using the distance E (Line C from FIG. 3) and the initial putt angle β. The value for D is the hole aim point or distance perpendicular to the left or right of the hole that the golfer must initially putt towards in order to hole the golf ball at a given velocity.

First, in FIG. 3, the distance C from golf ball 2 to the hole 4 is computed with the equation:

$$C=(A^2+B^2)^{1/2} \tag{9}$$

And the angle α is computed with the equation:

$$\alpha=a\tan(A/B) \tag{10}$$

Next, from FIG. 4, the aim angle β for a successful putt computed from an optimization process, such as a genetic algorithm operation described above, is used to find the aim distance D perpendicular to the hole with the equation:

$$D=\tan(\beta)*E \tag{11}$$

Figure 5:
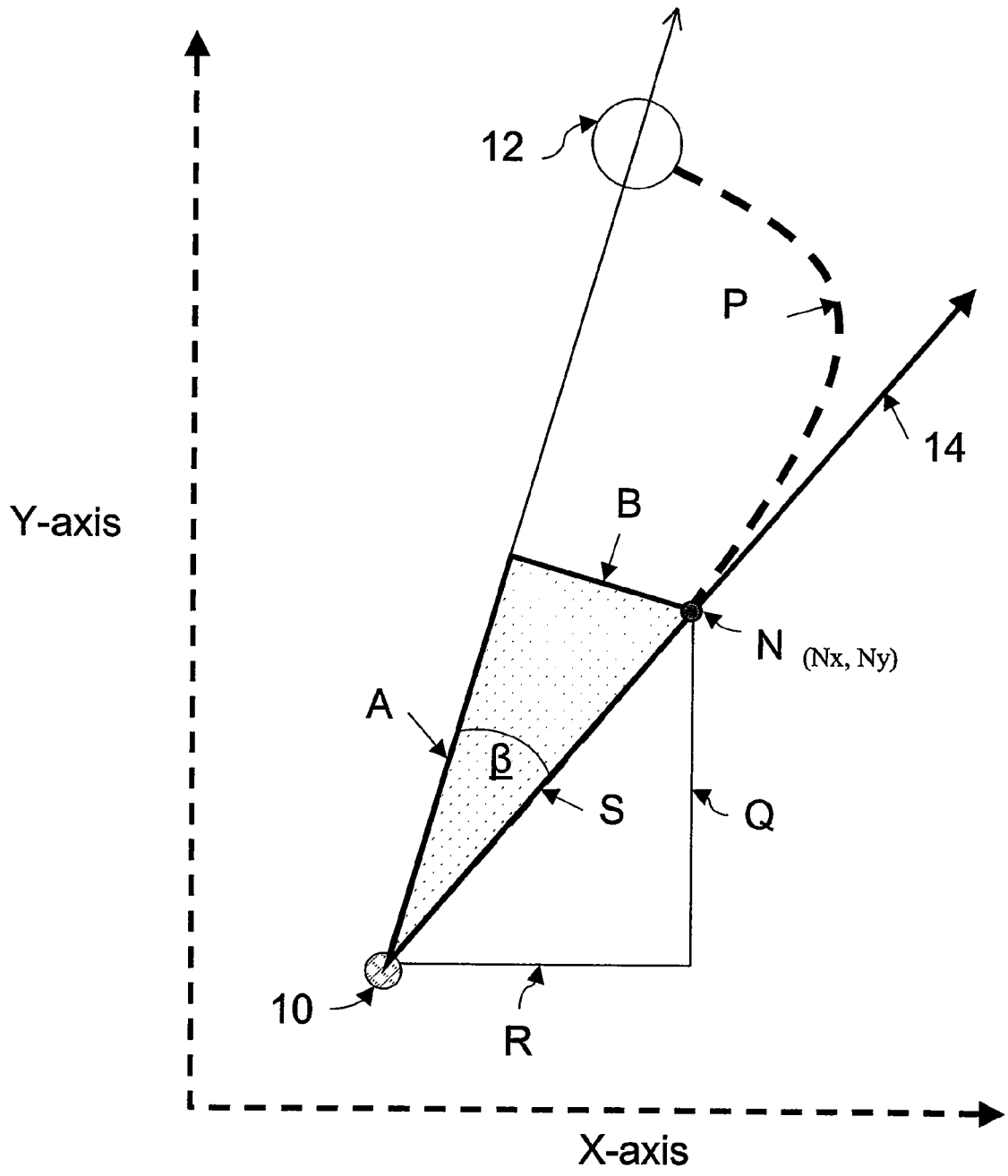
FIG. 5 depicts an alternate aim point corresponding to the initial break point of a putt trajectory.

In FIG. 5, an alternate aim point N that represents the initial break coordinates for a desired putt path P can also be computed. Coordinates (Nx, Ny) for the break point N are defined as where the ball 6 first begins to visually deviate from an original putt vector 10. Distances A and B in FIG. 5 represent how far forward and to the side from straight line between the ball 6 and the hole 8 the golfer must aim his putt. First, the break amount is calculated during the path trajectory given an arbitrary value of what a significant deviation from the original vector would be:

$$\phi=a\tan((y_i-y_1)/(x_i-x_1)) \tag{12a}$$

$$\text{if } (x_i<x_1)\ \phi=\phi+\pi \tag{12b}$$

$$d=\text{sqrt}((x_i-x_1)^2+(y_i-y_1)^2) \tag{12c}$$

$$b=d*\sin(\theta-\phi) \tag{12d}$$

where $x_1$ and $y_1$ are the initial ball coordinates, $x_i$ and $y_i$ are the current ball coordinates, φ is the initial launch angle, π is pi, and b is the amount the ball has deviated from the original putt vector 10. Once the break amount b is equal to the desired break amount, then the break point coordinates are the current values of $(x_i, y_i)$ and the distance to it equals:

$$\text{sqrt}((x_i-x_1)^2+(y_i-y_1)^2) \quad (12e)$$

Now the user may also aim his putt at a point which is closer to the ball—where the ball will first break—and which will still result in a successful putt given the required initial velocity.

Figure 6:
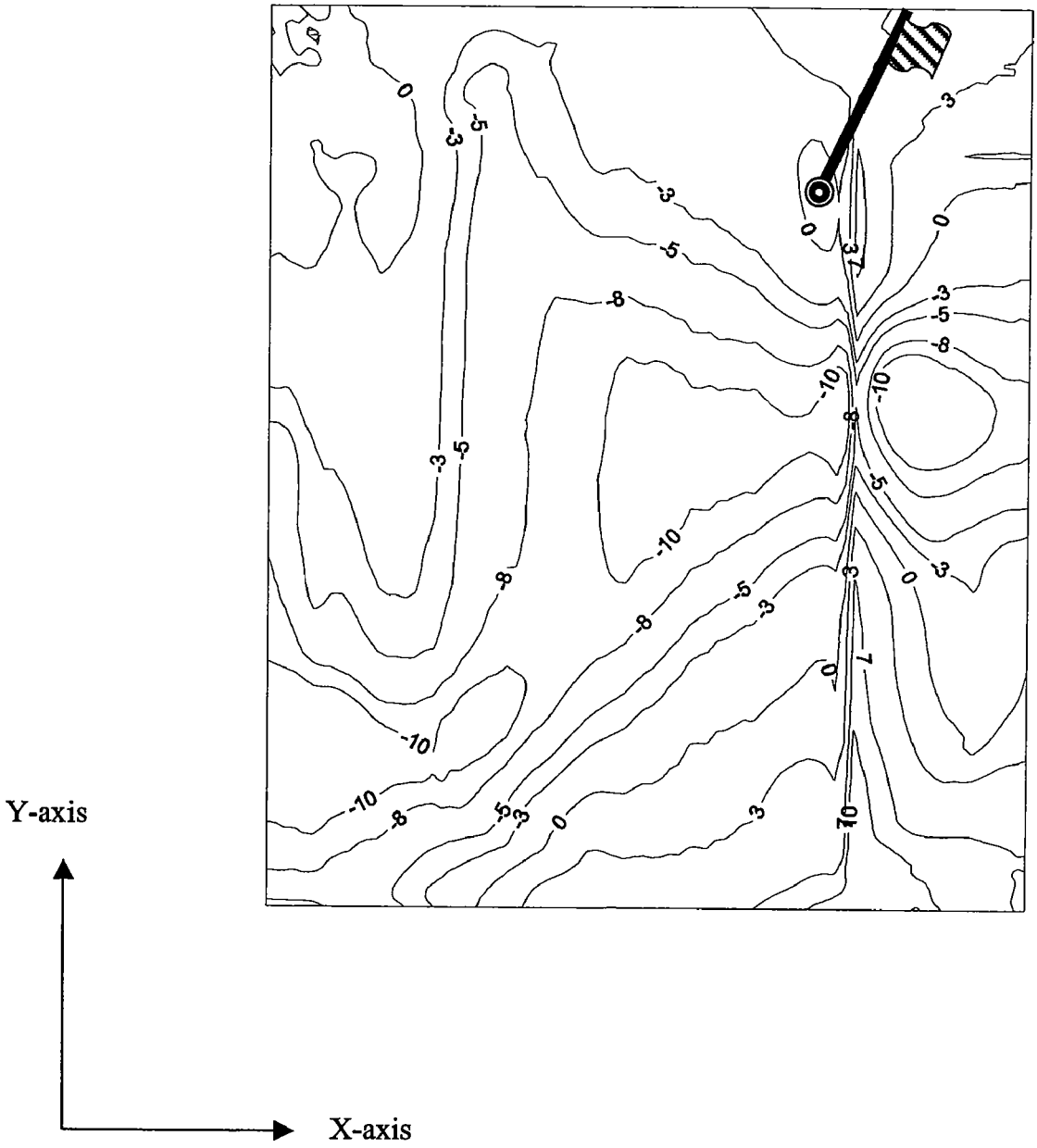
FIG. 6 depicts an exemplary contour chart having contours indicating aim distances for a particular hole position incorporated into one chart.

Once all the aim point distances are pre-computed for possible ball and hole positions, for different putting, or stroke, styles, and for different green speeds, a variety of graphical representations are available to the user. FIG. 6 depicts a graphical chart in which all the aim point distances are displayed with the use of a contour chart. A contour chart is a two-dimensional depiction of three-dimensional data. In FIG. 6, x and y coordinates represent ball position on the green, and the contour lines 12 represent z data, in this case, aim point distances, with the lines 12 showing aim point distances of equal value. A negative number indicates an aiming point left of the hole position 14, while a positive number indicates an aiming point to the right of the hole position 14. The spacing of the lines 12 represents the slope of the z data, or how quickly the aim distance changes relative to ball position. The distance between two contour lines is called the contour interval and can be adjusted based on user preferences. For example, the contour interval can be set at one inch or one foot, depending on how detailed the user wants to see contour changes. The exemplary contour chart is a single visual representation of all perpendicular aim points for a green given a single hole position 14, ending velocity, and green speed. The exemplary contour chart can also be color-coded within the contour interval so different z values can be represented by different colors. For example, all areas with aim distances of 12 inches can be colored blue, while all areas with aim distances of 18 inches could be colored red. Contour charts could be displayed in any media type such as a paper booklet, a handheld electronic device, or as a display option for in-cart video display GPS systems.

Figure 7:
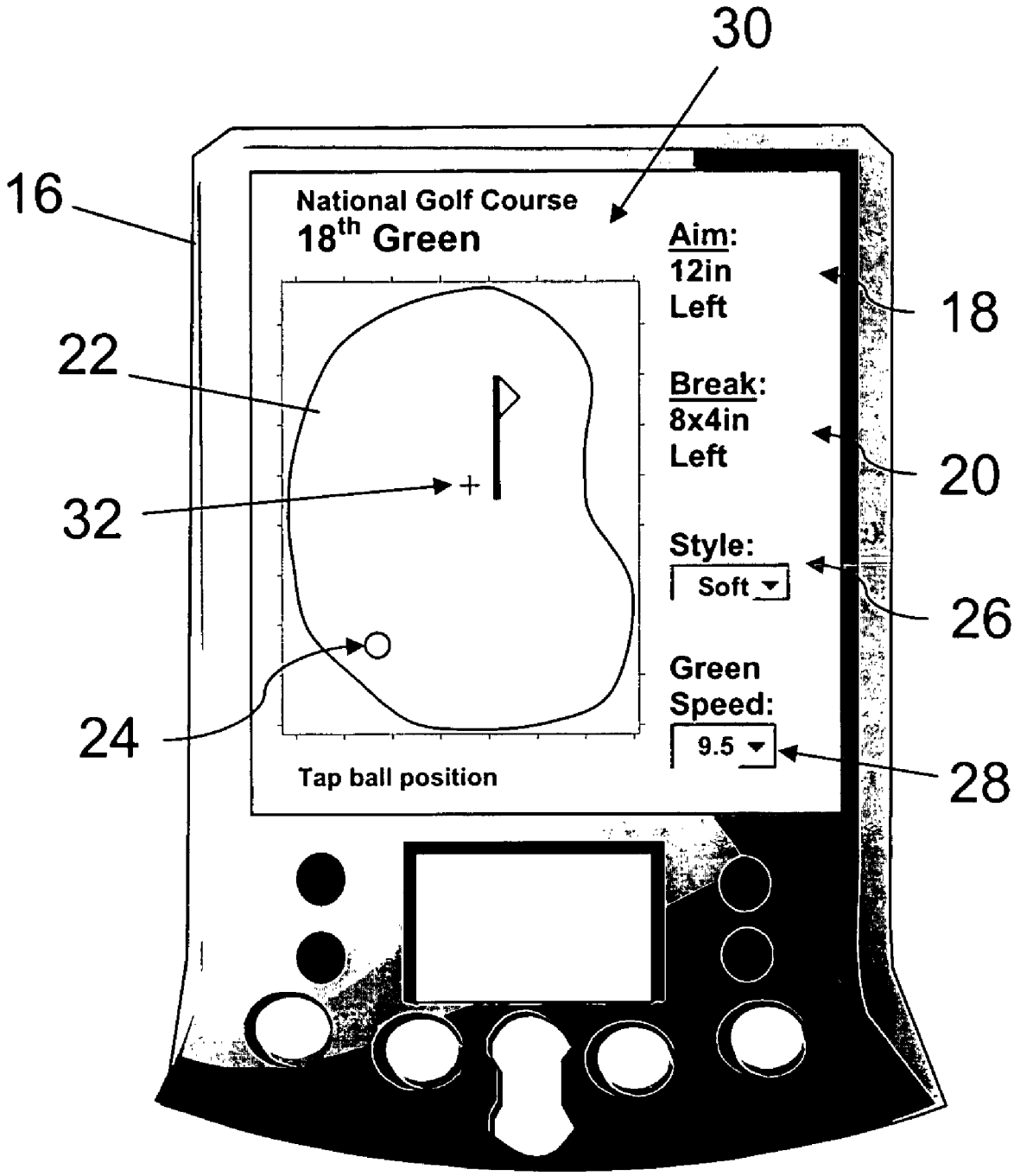
FIG. 7 shows an exemplary handheld electronic device having a graphical user interface (GUI) that may be used to determine aim points from the hole.

Pre-computed aim points could also be made available in other formats. FIG. 7 shows an exemplary handheld computing device 16, such as a PALM.® or Pocket PC personal digital assistant (PDA), which includes a GUI 30 to electronically display, for example, two aim point distances, hole aim point 18 and break point 20, and an aim point indicator 32, for a green 22, once the ball position 24 has been determined, either manually or via an automatic locator function, such as by a GPS receiver. For example, a GPS receiver may be attached to the hand held computing device 16 and the device positioned over the ball 24 to record the ball's 24 location on the green. For manual ball location, the user could simply tap the screen to indicate where on the green 22 he believes his ball 24 to be. The device 16 would then show aim point distances 18 and 20 and the aim indicator 32 immediately, and give the user the option to toggle a preferred putting style 26 and the green speed 28 in order to display the corresponding aim point distances 18 and 20. In an aspect of the hand held computing embodiment, audio indicia could be provided to announce information provided on the GUI, such as aim distances, style of stroke, and green speed. In a further handheld embodiment the device may be programmed to accept verbal commands. The handheld may be programmed to receive information such as topography information, aim data, DTM information, or course condition information, for example, while playing a round of golf, so that the most current aiming information can be provided.

Figure 9:
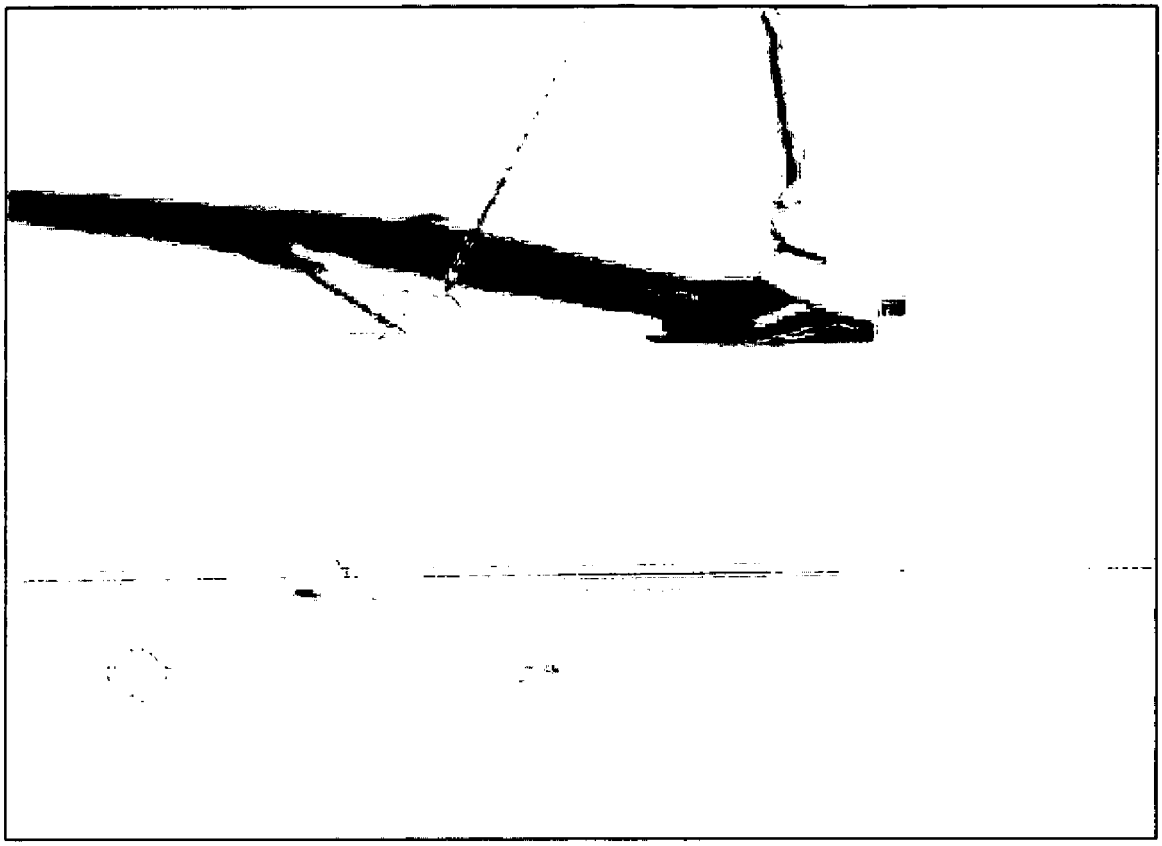
FIG. 9 shows a video overlay of the optimal path and aim point coordinates.

Another application of the invention is to use the computed aim data and path coordinate data as a basis for an overlay on video streams which shows the optimal path trajectory, or, once the ball has been stuck, which shows the actual path trajectory based on the known start and end coordinates of the ball (FIG. 9). Given the known start and ending coordinates of the ball, the invention is able to determine the path and initial conditions required to have produced that particular trajectory.

Figure 10:
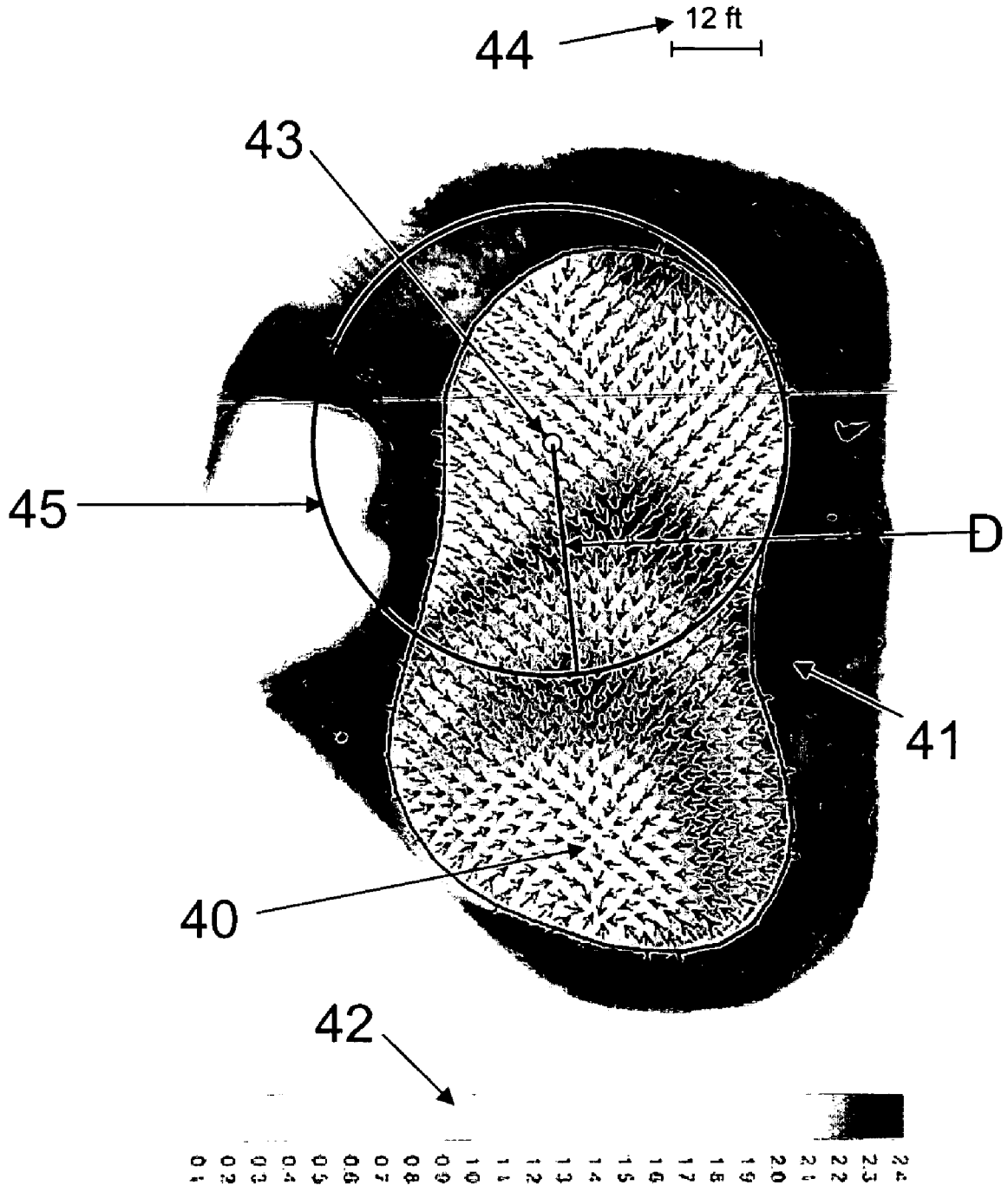
FIG. 10. depicts a chart of a golf green which has arrows indicating the direction of the slope of the green at regular intervals and a which is color-coded (including a scale bar) to indicate the relative surface elevations.

Another form of the invention is a set of charts which depict highly accurate surface data of the golf green as seen in FIG. 10. These charts are based on the DTM data collected for each golf green and have contour lines and arrows 40 at regular intervals which indicate the precise direction and magnitude of the slope on the surface of the green. These directional arrows can be made more or less dense depending on user preferences. The arrows can also be drawn to indicate magnitude of the slope by using different colors and/or shaft lengths. The arrows 40 in FIG. 10 use longer, red arrows to show more severe slopes and shorter blue and purple arrows to show slopes of lesser magnitude. The chart also has arrows and contour lines 41 outside the perimeter of the green which show the surrounding terrain slope features. Additionally, the green surface is color-coded and has an attending scale bar 42 which indicates the relative surface elevations of the green at any point, with the lowest point of the green having a zero relative elevation. The daily hole location 43 is indicated to further aid the golfer in understanding slope characteristics affecting his putt. A scale reference 44 is also displayed to assist the user in gauging distances. In electronic form, the user is able to enter his ball's distance D from the hole and a circle 45 with radius D will be shown so that the user can pinpoint his ball position more easily. This chart can be displayed in any media including electronic and print, and the hole position indicator can be automatically updated.

In another form of the invention, aim point data may be related to a green difficulty scoring system that ranks the relative difficulty of putting from different areas on the green to a pin position on the green. The scoring system may be based on the computed distance C and hole aim point distance D data from FIGS. 3 and 4 respectively. One measure of putting difficulty may be a ratio of the amount of break D to distance C to the hole, with a higher value selected to represent a greater break-to-distance ratio. This ratio may be defined as:

$$D/C \quad (13)$$

The measure can be further enhanced by including elevation change data between the ball 10 and the hole 12. For example, if the user determines that downhill putts are relatively more difficult than equivalent distance uphill putts, he can add a weighting to the break-to-distance ratio using the equation:

$$(D/C)*(|E|*\mu_U|\mu_D) \quad (14)$$

where |E| is the absolute value of the vertical change in elevation between the ball 10 and the hole 12 which is multiplied by a different factor for uphill or downhill. $\mu_U$ is a weighting factor for uphill putts and $\mu_D$ is a weighting factor for downhill putts that all give E a variable degree of weighting in the overall difficulty assessment. The result is that two putts with the same break-to-distance ratio can be differentiated in their relative difficulty depending on whether they are uphill or downhill.

Figure 8:
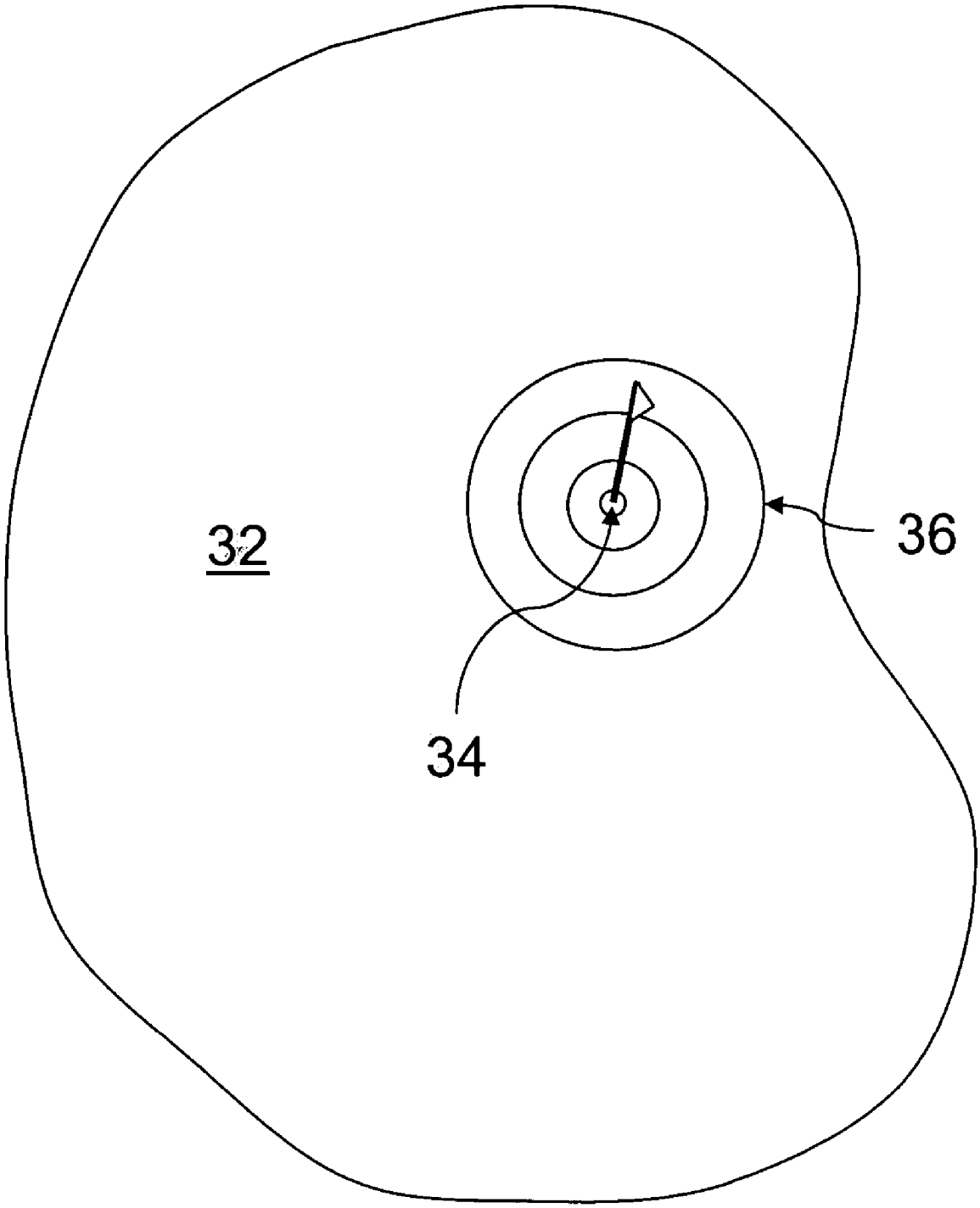
FIG. 8 shows concentric circles around a hole on a green that are useful for calculating putting difficulty scores within certain ranges from the hole.

A method of computing areas of putting difficulty for a desired green 32 is shown in FIG. 8. The concentric circles 36 represent areas on a green 32 of arbitrary radius from the hole 34 whose inner points are used in calculation (14) and then averaged together to get a single putting difficulty rating for a distance range around the hole 34. Since long putts are typically more difficult than short putts, this method determines the relative difficulty of putts of equivalent length, or within a certain range. Therefore, if considering putts in the six to eight foot range, this method can show the hole position where six to eight foot putts are most difficult, on average.

Aim point data could also be used in a software simulation program designed to assist a golfer in preparing for golf rounds. A user could prepare in advance by becoming acquainted with green break characteristics without having to putt on the actual green. The software program would contain graphics of the green including vector maps, aim point contour maps, and putt difficulty ratings for any area on the green.

Figure 11:
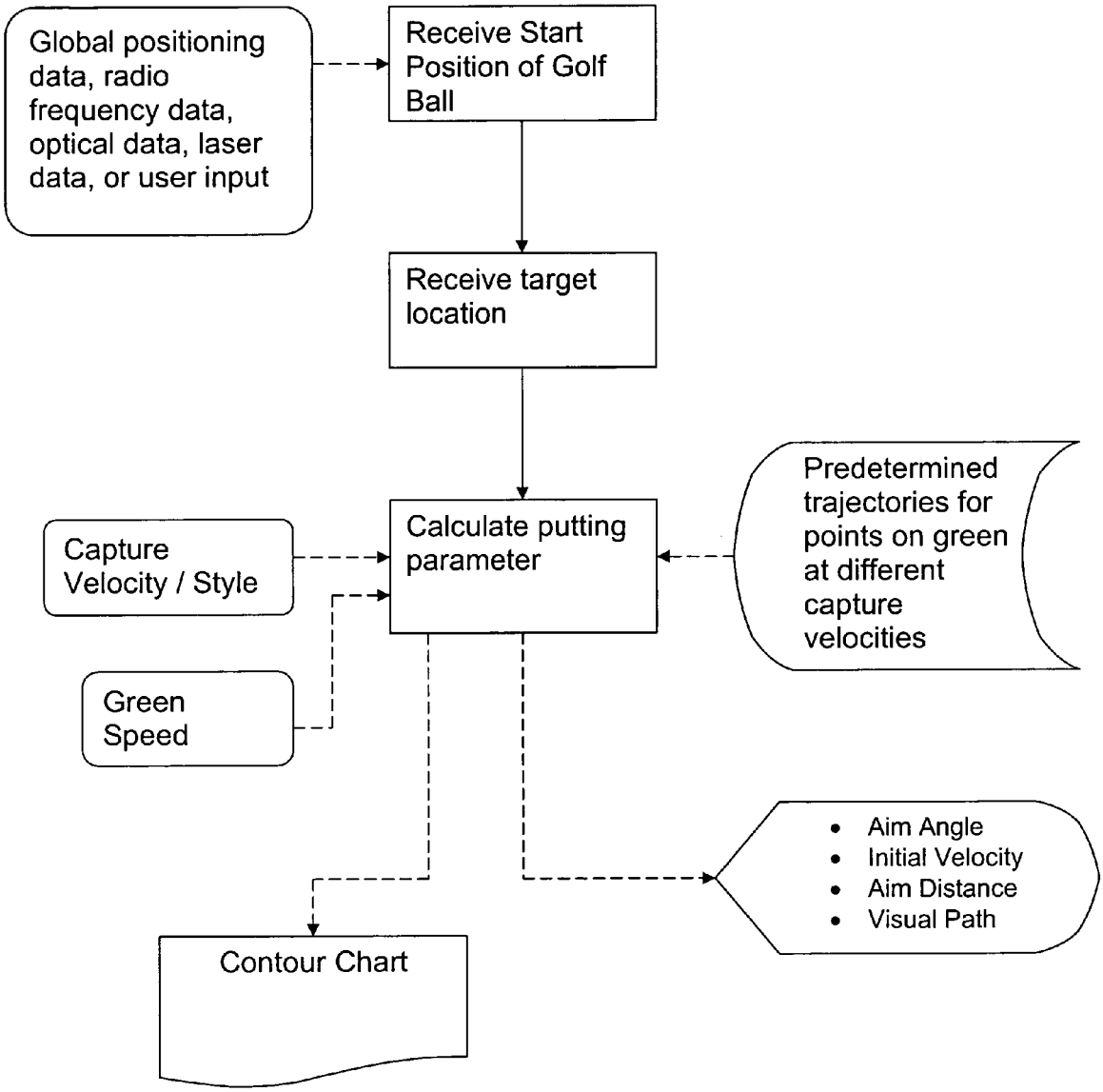
FIG. 11 shows a flow chart demonstrating the methods of the invention.

Turning to FIG. 11, a flowchart illustrates the method of the invention. The main steps include (1) receiving a start position of a golf ball relative to the putting green; (2) receiving a desired target location relative to the putting green; and (3) calculating a putting parameter for propelling the golf ball from the start position to the target location based on a trajectory corresponding to a desired capture velocity of the ball, wherein the trajectory has a start point substantially corresponding to the start position and an end point substantially corresponding to the target location. The putting parameters displayed may include an aim angle, an initial velocity, an aim point distance (and direction) relative to the target location based on the aim angle, and/or a visual path. The method may further include receiving the desired capture velocity of the ball, wherein capture velocity is the velocity at which the ball passes through the target location including, but not limited to, being captured in the hole. Other parameters may include a green speed parameter and grain. Predetermined trajectories for points on green at different capture velocities may be predetermined to speed up the calculations of the method when in use. Moreover, the method may provide for contour charts that include the putting parameters.

Based on the foregoing specification, the invention may be implemented using computer programming or engineering techniques including computer software, firmware, hardware or any combination or subset thereof. Any such resulting program, having computer-readable code means, may be embodied or provided within one or more computer-readable media, thereby making a computer program product, i.e., an article of manufacture, according to the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware to create a computer system, such as a hand held computer or PDA, or computer sub-system embodying the method of the invention. An apparatus for making, using or selling the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody the invention. User input may be received from the keyboard, mouse, pen, voice, touch screen, or any other means by which a human can input data into a computer, including through other programs such as application programs.

It should be understood that the examples and embodiments described herein are for illustrative purposes only and that various modifications or changes in light thereof will be suggested to persons skilled in the art and are to be included within the spirit and purview of the claims. The following references cited throughout this application are all incorporated herein by reference in their entirety to the extent they are not inconsistent with the explicit teachings of this specification.

[1]Yamrom, et al. U.S. Pat. No. 5,146,557

[2]Lorensen and Yamrom. 1992. Golf Green Visualization. *IEEE Computer Graphics Appl.*

[3]A. R. Penner. The Physics of Putting. *PACS No.*:01.80+b, Physics Department, Malaspina University-College, Nanaimo, B.C. Canada.

[4]Robert Vanderbei. 2000. A Case Study in Trajectory Optimization: Putting On An Uneven Green. *Technical Report* ORFE-00-4, Dept. of Operations Research and Financial Engineering, Princeton University, Princeton, N.J.

[5]Mont Hubbard and LeRoy Alaways. 1999. Mechanical Interaction of the Golf Ball With Putting Greens. *Science and Golf III* 54: 438

[6]Salazar and Sanchez-Lavega. 1989. Motion Of A Ball On A Rough Horizontal Surface After Being Struck By A Tapering Rod. *IOP Publishing LTD & The European Physical Society.*

[7]Isaaks, E. H. and Srivastava, R. M. 1989. *An Introduction To Applied Geostatistics*. Oxford University Press, New York. 561 pp.

[8]Lee, D. T. and Schachter, B. J. 1980. Two Algorithms for Constructing a Delaunay Triangulation. *International Journal of Computer and Information Sciences*. v.9, n.3, p.

What is claimed is:

1. A method of providing putting information overlaid on a video of the putting green comprising:

receiving a start position of a golf ball relative to the putting green;

receiving a desired target location representing a particular hole relative to the putting green;

calculating a plurality of trajectories for a plurality of different putting styles that represent different capture velocities that would result in capture of the golf ball in the particular hole from the start position, by calculating gradients between adjacent points on a surface model of a putting green and predicting putt data by simulating a rolling motion of the golf ball using the gradients and equations of motion involving the plurality of different capture velocities that simulate the rolling motion of the golf ball on a sloped green including a calculation for an acceleration accounting for a frictional force including a coefficient of rolling friction, determining an optimal path trajectory for the particular hole and start position based on one of the plurality of trajectories corresponding to a desired putting style that corresponds to a particular capture velocity of the ball;

computing a putting parameter for propelling the golf ball from the start position to the target location based on the optimal path trajectory, wherein the putting parameter comprises initial launch conditions comprising an initial putt angle, an initial velocity, and further computing an aim point distance perpendicular to the left or right of the target location for the particular hole and start position;

graphically overlaying on a video of the putting green (a) an aim point icon representing the aim point distance wherein the aim point icon is a point located to the left or right on a line intersecting the target location, and wherein the line corresponds to an opposite side of the initial putt angle in a right triangle oriented with the right angle intersecting the target location; and (b) a visual representation of said optimal path trajectory.

2. The method of claim 1, wherein each different capture velocity corresponds to a different end point of the path trajectories, the end point located at or beyond the target location, wherein the different capture velocities correspond to different putting styles.

3. The method of claim 1, wherein the putting parameter further comprises a break point coordinate (Nx, Ny) computed based on an initial break coordinate along the optimal path trajectory wherein the ball is calculated to break.

4. The method of claim 3 wherein the putting parameter comprises a break point distance relative to the initial break coordinates for the target location, wherein the break point distance comprises a distance perpendicular to the left or right of and intersecting the break point coordinate (Nx, Ny).

5. The method of claim 1, further comprising:

receiving topography information corresponding to the putting green;

converting the topography information into the smoothed surface model; and generating an elevation file comprising points on a grid extracted from the smoothed surface model;

predetermining successful putt data for a plurality of points on a surface model of a putting green wherein the successful putt data comprises path trajectories and initial launch conditions for a plurality of different capture velocities that would result in capture of a golf ball in a hole, by calculating gradients between adjacent points and predicting putt data for each point by simulating rolling of the golf ball using the gradients and equations of motion involving the plurality of different capture velocities such that the step of calculating the plurality of trajectories that would result in capture of the golf ball in the particular hole from the start position uses the predetermined successful putt data from points close to the start position as beginning values to solve for the plurality of trajectories.

6. The method of claim 5 wherein the putting parameter is calculated by selecting and averaging optimal values from a plurality of grid points on the green closest to the position of the golf ball.

7. The method of claim 1, wherein calculating the plurality of trajectories comprises:

computing slopes from the gradients between adjacent points on the surface model of the putting green; and wherein the coefficient of rolling friction of the ball ρ is computed using the formula:

$$\rho=(0.7028/s)(1+0.0065v^2)$$

wherein s is a stimpmeter reading of the green and v is velocity.

8. The method of claim 7 wherein the coefficient of rolling friction is adjusted for an effect of grain.

9. The method of claim 8 wherein the effect of grain is calculated with the formula:

$$\rho'=\rho*(\delta*\cos(\gamma-\beta));$$

where δ is the magnitude of grain effect on the ball, γ is the grain direction in degrees, and β is the direction the ball is moving.

10. The method of claim 1, further comprising displaying indicia indicative of a slope direction and slope magnitude of a portion of the putting green.

11. The method of claim 1, further comprising displaying indicia indicative of a difficulty of an attempt to propel the golf ball from the position to the target location.

12. The method of claim 1 wherein receiving a position of a golf ball relative to the putting green comprises receiving one or more of global positioning data, radio frequency data, optical data, manual input by a user, or laser data.

13. The method of claim 1, further comprising outputting audio indicia indicative of the putting parameters.

14. The method of claim 1 further comprising simulating a putt based on a simulated position of a golf ball.

15. The method of claim 1 wherein the plurality of trajectories are calculated using genetic-algorithm based optimizers using one or more of the values of green speed, capture velocity, starting ball position, and ending ball position.

16. The method of claim 1 wherein the equations of motion that simulate the rolling motion of the golf ball are adjusted for an effect of grain and a gravitational force.

17. A computing device for providing putting information overlaid on a video of the putting green, comprising:

input mechanism for receiving a start position of a golf ball relative to the putting green and receiving a desired target location representing a particular hole relative to the putting green;

a processor for calculating a plurality of trajectories for a plurality of different putting styles that represent different capture velocities that would result in capture of the golf ball in the particular hole from the start position, by calculating gradients between adjacent points on a surface model of a putting green and predicting putt data by simulating a rolling motion of the golf ball using the gradients and equations of motion involving the plurality of different capture velocities that simulate the rolling motion of the golf ball on a sloped green including a calculation for an acceleration accounting for a frictional force including a coefficient of rolling friction;

determining both an optimal path trajectory for the particular hole and start position based on one of the plurality of trajectories corresponding to a desired putting style that corresponds to a particular capture velocity of the ball;

computing a putting parameter for propelling the golf ball from the start position to the target location based on the optimal path trajectory, wherein the putting parameter comprises initial launch conditions comprising an initial putt angle, an initial velocity, and further computing an aim point distance perpendicular to the left or right of the target location for the particular hole and start position;

an output device for graphically overlaying on a video of the putting green (a) an aim point icon representing the aim point distance wherein the aim point icon is a point located to the left or right on a line intersecting the target location, and wherein the line corresponds to an opposite side of the initial putt angle in a right triangle oriented with the right angle intersecting the target location; and (b) a visual representation of said optimal path trajectory.

18. The computing device of claim 17, further comprising a storage media for storing the plurality of trajectories.

19. A computer readable media containing program instructions for providing putting information overlaid on a video of the putting green, comprising:

first computer program code for receiving a start position of a golf ball relative to the putting green;

second computer program code for receiving a desired target location representing a particular hole relative to the putting green;

third computer program code for calculating a plurality of trajectories for a plurality of different putting styles that represent different capture velocities that would result in capture of the golf ball in the particular hole from the start position, by calculating gradients between adjacent points on a surface model of a putting green and predicting putt data by simulating a rolling motion of the golf ball using the gradients and equations of motion involving the plurality or different capture velocities that simulate the rolling motion of the golf ball on a sloped green including a calculation for an acceleration accounting for a frictional force including a coefficient of rolling friction;

determining an optimal path trajectory for the particular hole and start position based on one of the plurality of trajectories corresponding to a desired putting style that corresponds to a particular capture velocity of the ball;

computing a putting parameter for propelling the golf ball from the start position to the target location based on the optimal path trajectory, wherein the putting parameter comprises initial launch conditions comprising an initial putt angle, an initial velocity, and further computing an aim point distance perpendicular to the left or right of the target location for the particular hole and start position;

fourth computer program code for graphically outputting as an overlay on a video of the putting green (a) an aim point icon representing the aim point distance wherein the aim point icon is a point located to the left or right on a line intersecting the target location, and wherein the line corresponds to an opposite side of the initial putt angle in a right triangle oriented with the right angle intersecting the target location and (b) a visual representation of said optimal path trajectory.

* * * * *